US005094625A

United States Patent [19]

Le Gouic Martun et al.

[11] Patent Number: 5,094,625

[45] Date of Patent: Mar. 10, 1992

[54] CONNECTION SYSTEM FOR A SHIELDED FLAT CABLE

[75] Inventors: Jean-Jacques Le Gouic Martun, Esvres; Claude Bonnin, Monts; Michel De Mendez, Monthlery; Laurent Contardo, Boulogne; Jean Riverie, Epinay S/Senart, all of France

[73] Assignee: SOURIAU et Cie, Boulogne-Billancourt, France

[21] Appl. No.: 606,609

[22] Filed: Oct. 31, 1990

[30] Foreign Application Priority Data

Oct. 31, 1989 [FR] France ..... 89 14285

[51] Int. Cl.[5] ..... H01R 9/07

[52] U.S. Cl. ..... 439/495; 439/498; 439/817; 439/819

[58] Field of Search ..... 439/578, 581, 492–499, 439/67, 66, 731, 752, 816–820, 824

[56] References Cited

U.S. PATENT DOCUMENTS

| | | | |
|---|---|---|---|
| 3,745,509 | 7/1973 | Woodward et al. | 439/497 |
| 4,012,093 | 3/1977 | Crane | 439/77 |
| 4,453,792 | 6/1984 | Bright et al. | 439/251 |
| 4,743,080 | 5/1988 | Siraty | 439/492 |
| 4,934,946 | 6/1990 | Ordway | 439/77 |
| 4,983,271 | 1/1991 | Kato et al. | 439/839 |

*Primary Examiner*—David L. Pirlot
*Attorney, Agent, or Firm*—Pollock, Vande Sane & Priddy

[57] ABSTRACT

A system for connecting a flat shielded cable of the type comprising a stacking of three conductors, namely, one high voltage conductor and two low voltage equipotential conductors. The system comprises linking electric conductors partially uninsulated at their extremities, which are in intimate contact with corresponding tracks of the flat cable (10), elastic pads (40–43) making it possible to transmit sufficient pressure to the electric contact pickup linkages, and a casing (50, 51) formed of two half-shells closed on the unit constituted by the linkages and the elastic pads, and a device (60, 70) for retaining the two half-shells in either spaced apart or closed position. The system is used for the connection of high voltage cables.

13 Claims, 3 Drawing Sheets

CONNECTION SYSTEM FOR A SHIELDED FLAT CABLE

FIELD OF THE INVENTION

The invention concerns a system to connect a flat shielded cable and is particularly intended for flat cables comprising a stack of three conductors, one being a high voltage conductor and the others being low voltage equipotential conductors.

BACKGROUND OF THE INVENTION

French Patent 86 09102 describes a connector for a flat cable designed to electrically connect the tracks of two printed circuits or the tracks of a printed circuit with one flat cable or two flat cables between these tracks.

The connector described in this patent comprises a shape memory alloy collar inside which the conductor elements are superposed so as to be in electrical contact. The collar exerts a pressure on the electrical elements under the effect of a predetermined temperature, which ensures electric continuity between each superposed conductor.

However, such a connector can be used only for flat cables with parallel conductors in a given plane, and thus in effect can ensure the connection only between flat cables carrying low voltage signals.

Such a connector does not have the characteristics required for high voltage linkings or the morphology adapted to this type of linking enabling connection to be effected between flat shielded cables constituted by a stack of three conductors.

In fact, the need to reduce the spatial requirement of high voltage cables capable of carrying significant electric pulse energies has led to replacing coaxial cables of a cylindrical cross-section by flat shielded cables comprising a stack of three conductors, two of these conductors being low voltage equipotential conductors situated externally. The production of such cables falls within the technology relating to printed circuits. In fat, the three conductors comprise conductive layers of limited thickness (typically 35 μm) disposed on nonconducting layers.

However, the replacement of conventional cylindrical section coaxial cables with flat shielded cables constituted by a stack of three conductive tracks disposed on nonconducting layers has given rise to the need for systems for connecting two cables of this type, or one cable of this type and one cable of a different type. Such a system must be as small as possible to ensure (a) that contact is made without thermically or mechanically altering the conductive tracks or their non-conducting support, and (b) that, the system, when it is in a partial vacuum, is completely sealed off from the air around the contact pick-up zone of the high voltage conductor and/or between the pick-up zone of the high voltage conductor and the pick-up zones of the low voltage conductors.

Applicants have invented a connection system which overcomes the drawbacks of systems of the prior art, and which also has the required dielectric qualities enabling it to transfer a significant amount of pulse energy. By way of example, this energy is about one period of 1 μs under a voltage of about 3.500 V with an output approaching 1000 amperes irrespective of the pressure, the latter possibly being approximately the pressure corresponding to the minimum of Paschen curves.

SUMMARY OF THE INVENTION

The object of the present invention is to provide a system for connecting a flat shielded cable of the type comprising a stack of three conductors, one being a high voltage conductor and the other two being low voltage equipotential conductors, either to another flat cable or to another type of cable and it comprising:

linking means comprising electric conductors partially uninsulated at their extremities, which are in intimate contact with corresponding tracks of the flat cable so as to ensure the electric contact pick-up linkages between this cable and another cable, elastic pieces making it possible to transmit pressure to the electric contact pick-up links so as to provide these contacts, ensure retention of the flat cable and finally ensure imperviousness of the contact zones, a casing formed of two half-shells closed on the unit constituted by the linking means and the elastic pieces, and a device for keeping the two half-shells in either a spaced apart or closed position supplying the pressure transmitted by the elastic pieces.

According to one embodiment of the invention, the linking means are constituted by a single-conductor constituted by a conductive track housed in a non-insulating layer and by a twin-conductor made up of two superposed conductive tracks housed in non-conducting layers.

According to another embodiment of the invention, the linking means are constituted by three single-conductor cables, each being constituted by one conductive track coated with a non-conductor.

The elastic pieces are constituted by elastomer pads, and the two half-shells are constituted by an electrically rigid non-conducting material comprising a housing containing inside the elastomer pads the conductive linking tracks and the flat cable.

According to another characteristic of the invention, the holding device is constituted by U-shaped spring plates each of whose branches is housed in a half-shell, and by a shape memory alloy collar nesting substantially the entire casing, the plates and collar providing opposing forces.

According to another characteristic of the invention, the holding device is constituted by springs housed in the half-shells at their junction point and by a shape memory alloy collar nesting substantially the entire case, the springs and collar providing opposing forces.

According to another characteristic of the invention, the collar is provided with a spring plate.

According to another characteristic of the invention, the system comprises a polarization device.

According to a first application, the connection system allows for the connection between two shielded flat cables without impedance being broken, the conductive linking track of the first single-conductor cable allowing for contact pickup between two low voltage tracks of the two flat cables, the conductive linking track of the second single-conductor cable allowing for contact pickup between the high voltage tracks of the two cables, and the conductive track of the third single-conductor cable allowing for contact pickup between the other two low voltage tracks of these two cables.

According to a second application, the connection system allows for the connection between a flat shielded cable and a coaxial cable, the conductive linking track of the single conductor cable allowing for contact pickup between one low voltage track of the flat cable and the outer conductor of the coaxial cable, the conductive linking tracks of the twin-conductive cable allowing for contact pickup between, firstly, the high voltage track of the flat cable and the central conductor of the coaxial cable, and secondly between the other low voltage track of the flat cable and the external conductor of the coaxial cable.

BRIEF DESCRIPTION OF THE DRAWINGS

The invention will be more clearly understood from a reading of the following description, given by way of illustration and with reference to the accompanying drawings, in which.

DESCRIPTION OF PREFERRED EMBODIMENTS

In the following description, the same elements bear the same references.

Figure 1A:
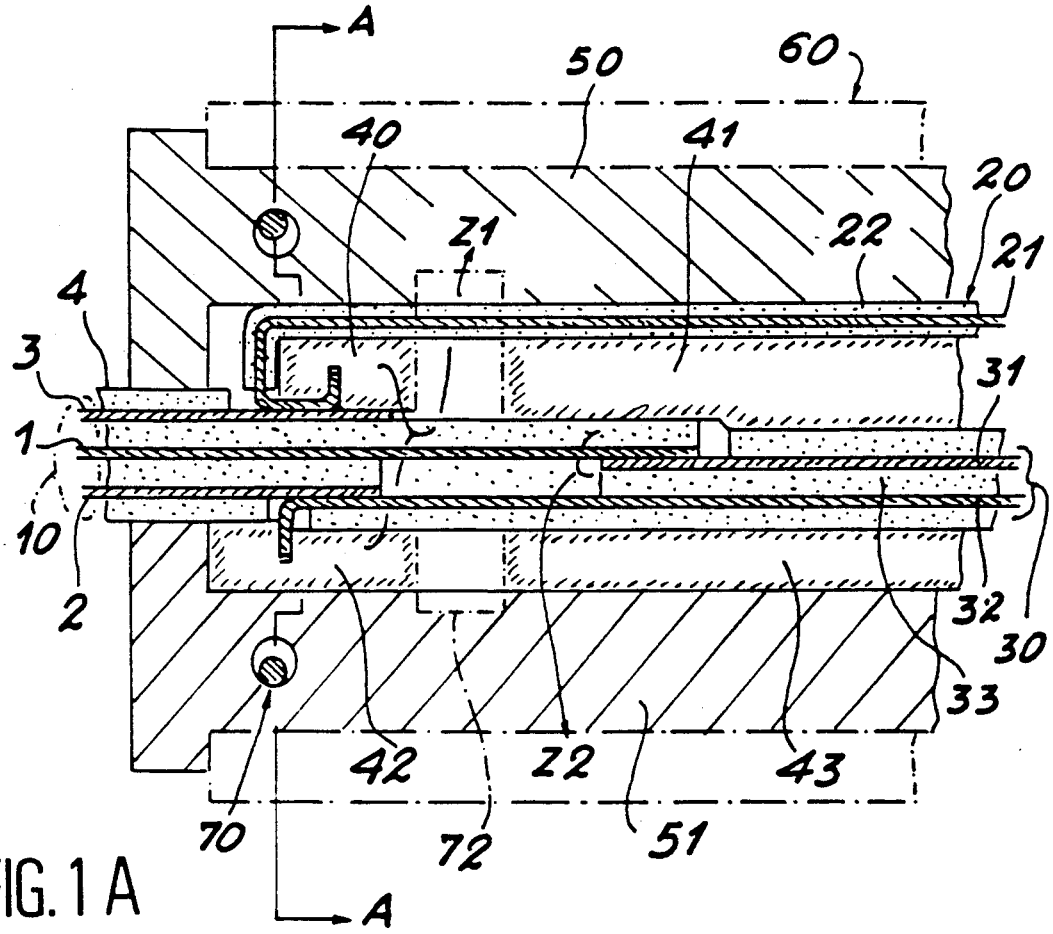
FIG. 1*a* is a sectional schematic view of a first embodiment of the connection system according to the invention.

FIG. 1A illustrates the principle of the system to connect a shielded flat cable according to the invention.

This system is adapted to connect a shielded flat cable to another cable, especially to another shielded flat cable or a coaxial cable.

The shielded flat cable 10 is constituted by three superposed conductive tracks housed between non-insulating layers 4.

The central track 1 is a high voltage track, the other two tracks 2 and 3 being low voltage equipotential tracks.

One end section of the shielded flat cable is housed inside the system. The ends of the tracks are uninsulated. The contacts with the cable to which the cable 10 is to be connected are formed by an insert forming linking means 20, 30 constituting an intermediate piece between the two cables to be connected. These contacts are marked by the zones Z1 and Z2. The insert forming linking means 20, 30 comprises electrical conductors 21, 31, 32, which are partially uninsulated at their ends and which are in intimate contact with the flat cable 10 so as to ensure the electric contact pickup linkages.

FIG. 1A shows a first embodiment of the linking means 20, 30 comprising one single-conductor cable 20 and one twin-conductor cable 30. The single-conductor cable comprises a conductive track housed in a non-insulating layer 22. The twin-conductor cable 30 comprises two superposed conductive tracks 31, 32 inserted in non-insulating layers 33.

As can be seen in FIG. 1A, the system comprises elastic pieces, preferably elastomer pads 40 to 43, allowing for transmission of the pressure supplied by the collar 60 to the electric contact pickup links so as to provide these contacts, ensure retention of the cable and imperviousness of the contact zones Z1, Z2.

The system also comprises a casing formed of two half-shells 50, 51 closed on the unit constituted by the linking means and the pads 40 to 43.

Figure 1B:
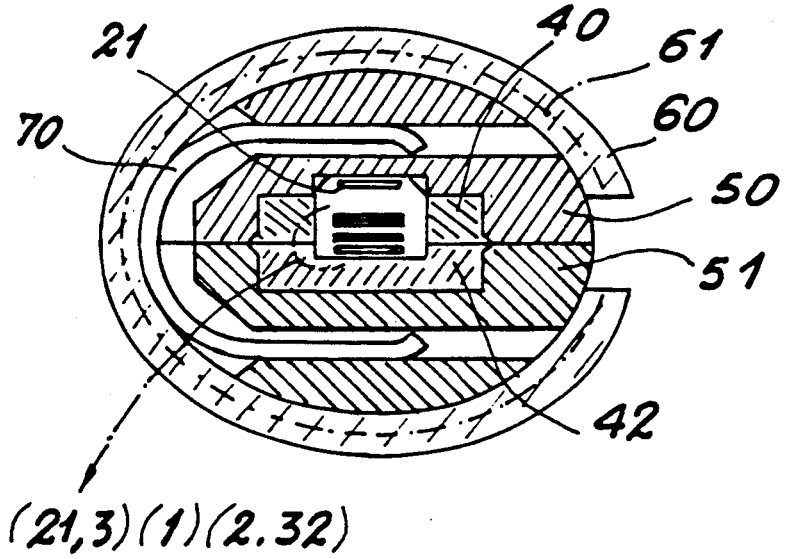
FIG. 1B shows a cross-section along line A——A of FIG. 1A.

As can also be seen from section A——A shown in FIG. 1B, the holding means comprise a shape memory alloy collars 60 which nests almost the entire case. The collar supplies sufficient pressure force on the elastomer pads during the normal use periods of the system and opens at low temperatures, (i.e., below the minimum use temperature $T < -100°$ C.), so as to allow for connection or disconnection of the cable with zero force.

In order to achieve this result, two variants are possible:

(1) The collars 60 receives a coating treatment which provides it with a double direction shape memory. Thus, the collar has two shapes according to its temperature. For a temperature T, for example greater than $-100°$ C., it compresses the elastomer pads, for a temperature T of less than $-100°$ C., it opens and frees the pads, (2) The collar 60 is not coated in this way, but is supplemented by an armature constituted by a spring plate 61 so as to obtain the change of shape on cooling.

According to one embodiment, the holding means further comprise a U-shaped spring plate 70.

The spring plate 70 and the collar 60 exert opposing forces. The collar 60 ensures closing of the system when the latter is at a normal use temperature. On the other hand, spring plate 70 tends to diverge so as to free the cables as soon as the collar is at an extremely low temperature.

The system further comprises polarization means 72.

Figure 2A:
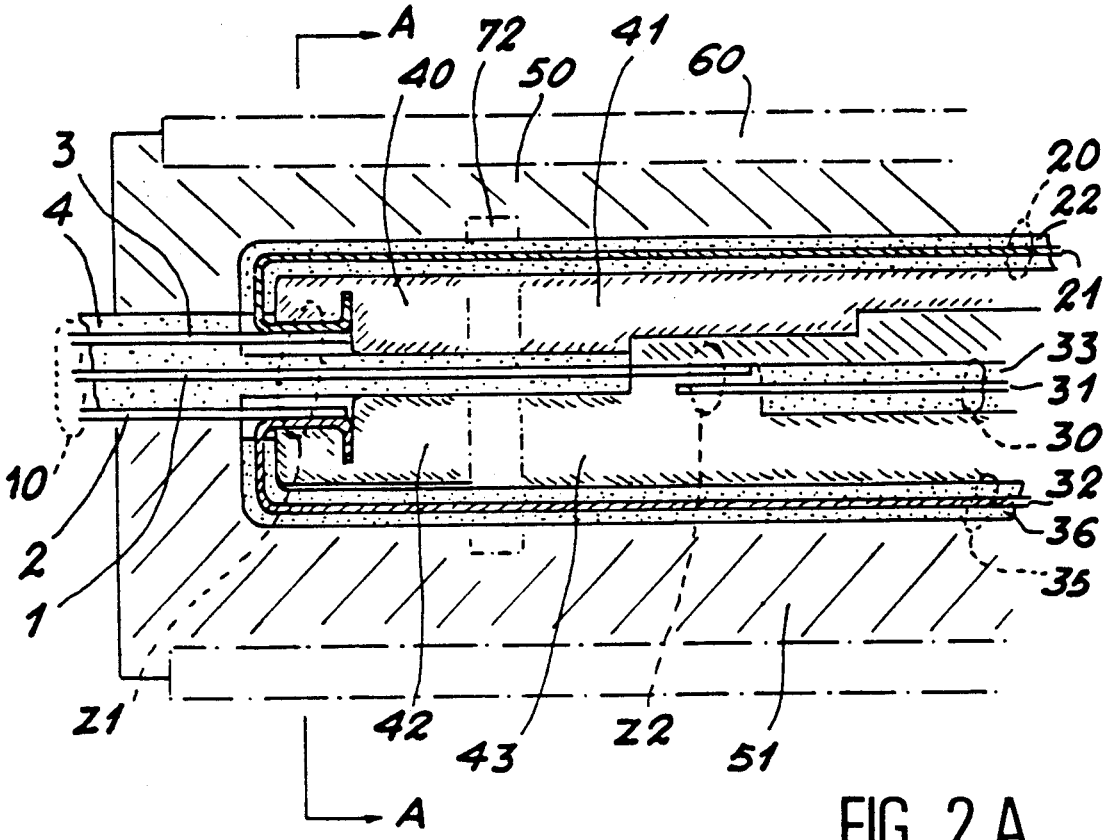
FIG. 2A is a schematic sectional view of a second embodiment of the connection system according to the invention.

FIG. 2A shows a connection system according to the invention viewed as a section along a longitudinal plane so as to illustrate a second embodiment of the linking means 20, 30 and 35.

According to this embodiment, the linking means comprise three single-conductor cables. The two low voltage contact pickup cables 20 and 35 have identical shapes.

These three cables 20, 30 and 35 are each constituted by a low voltage conductive track 21 and 32 and a high voltage conductive track 31 and are coated with a non-conducting layer 22, 36 and 33.

Figure 2B:
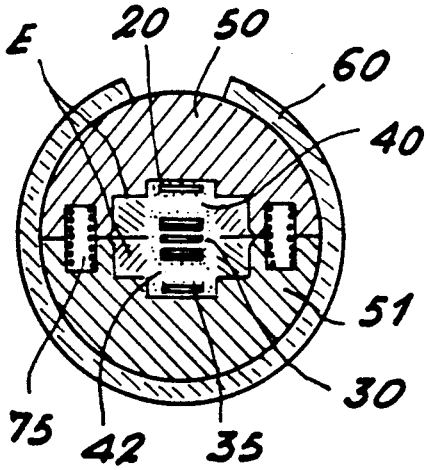
FIG. 2B shows a cross section A——A of the system according to FIG. 2A, in closed position.
Figure 2C:
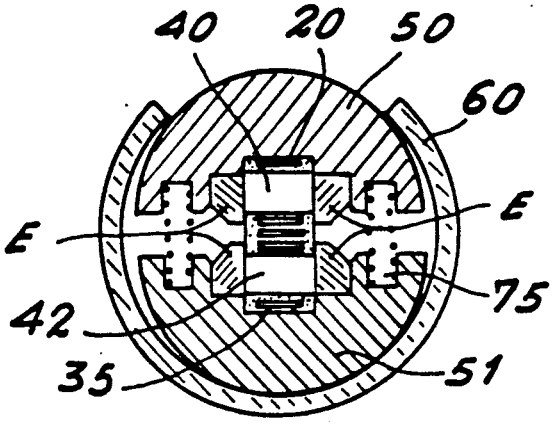
FIG. 2C shows a cross section A——A of the system according to FIG. 2A, in open position.

FIGS. 2B and 2C show the same cross section A——A, FIG. 2B showing the closed position, and FIG. 2C the open position.

These figures show the holding means constituted by a shape memory alloy collar 60 and by springs 75 placed at the junction points of the two half-shells 50, 51. The springs constitute a variant of the spring plate 70 shown in FIG. 1B. In fact, these two solutions are equivalent, both being adapted to the two variants of FIGS. 1A and 2A. As in the case of FIG. 1A, the collar 60 exerts a pressure on the pads 40 to 43 so as to ensure the electric contacts and complete airtightness. This airtightness is reinforced for the elastomer collars E.

Figure 3A:
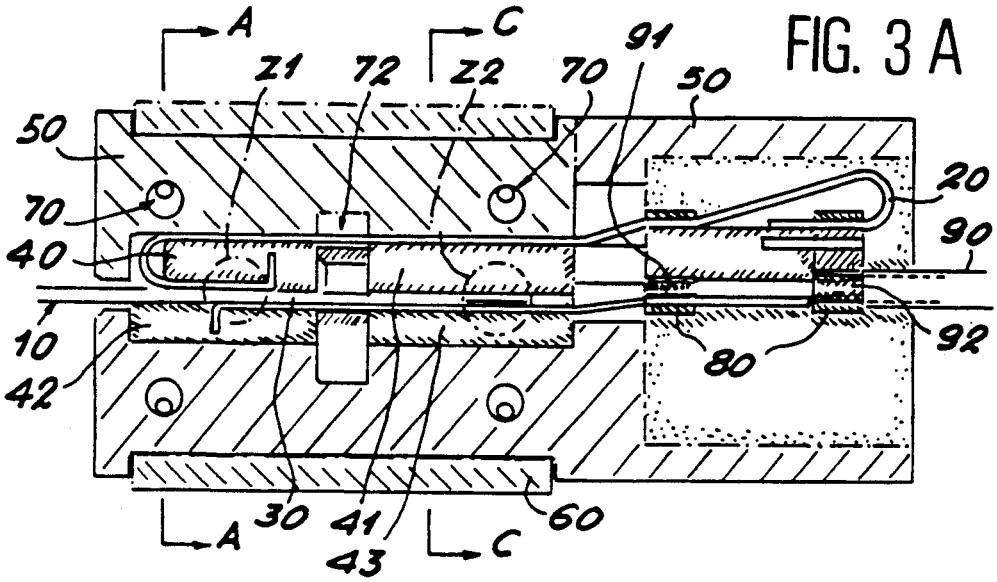
FIG. 3A schematically shows the connection system in a flat cable/coaxial cable application.

FIG. 3A is a diagram of a connection system according to the invention which applies to the connection of one flat cable 10 and one coaxial cable 90.

For the sake of simplicity, the layered structure of the cables namely, the flat cable and the linking means, has not been shown.

The system comprises in its right-hand section a housing for inserting the end of the coaxial cable 90 and definitively placing this coaxial cable in contact with the linking means.

Figure 3B:
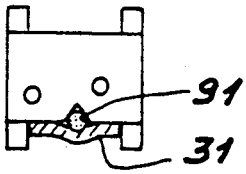
FIGS. 3B, 3C, 3D and 3E show details relating to FIG. 3A.
Figure 3C:
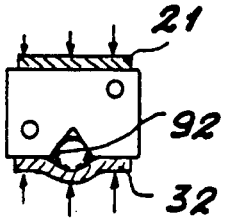

This contact between the linking means is also shown in FIGS. 3B and 3C.

FIG. 3B illustrates the contact between the high voltage track 31 and the central conductor 91. The arrows symbolize the pressure exerted by the shape memory alloy collars 80 (FIG. 3A).

FIG. 3 illustrates the contact between the low voltage track 32 and the outer conductor 92 of the coaxial cable.

Figure 3D:
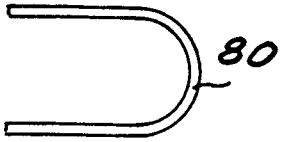

FIG. 3D illustrates an example of the collar 80.

Figure 3E:
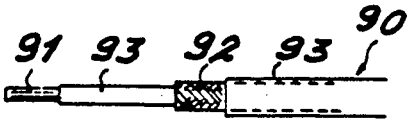

FIG. 3E illustrates the end of the coaxial cable 90 which is to be inserted in the system.

Figure 4:
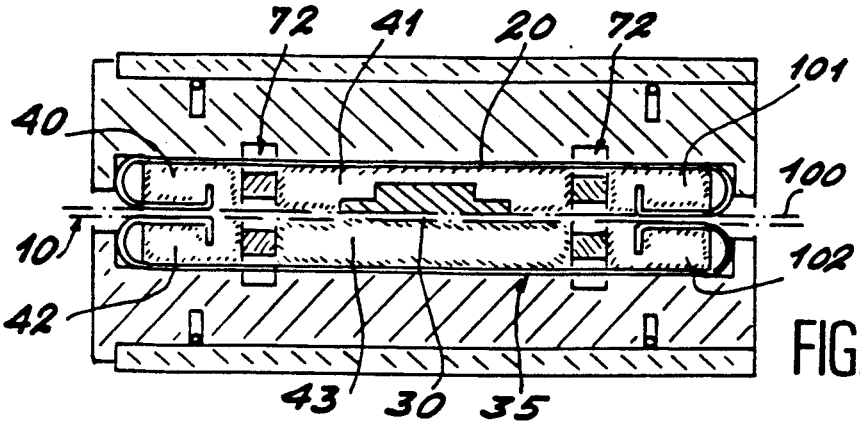
FIG. 4 schematically shows the connection system in another flat cable/coaxial cable application.

The reference 93 corresponds to another application example, shown in FIG. 4, namely that of a connection between two shielded flat cables.

In this application, the system is perfectly symmetrical, although this is not strictly essential for its functioning. The connection principle is identical to the principles described with reference to FIG. 1A and 2A.

In this application, two other elastomer pads 101 and 102 are used, having the same function as the pads 40 and 42 for the second shielded flat cable 100.

The connection system in this application also does not provoke any impedance rupture.

What is claimed is:

1. System for selectively connecting a shielded flat cable comprising a stack of three conductors, namely a high voltage conductor and two low voltage equipotential conductors, to a second flat cable and to another type of cable, said system comprising (a) electric contact pickup links;

(b) elastic pieces, located between the said electric contact pickup links, for transmitting pressure to said electric contact pickup links so as to ensure contacts, retention of said flat cable and imperviousness of contact zones;

(c) a casing comprising two half-shells closed onto said electric contact pickup links and said elastic pieces; and (d) a shape memory alloy collar nesting said casing.

2. System according to claim 1, wherein said electric contact pickup links are formed by conductors having partially insulated ends, being disposed in an insert, and being in intimate contact with corresponding conductors of said cables to be connected so as to ensure contact pickup electric links between the respective cables.

3. System according to claim 1, wherein said electric contact pickup links are constituted by one single-conductor cable constituted by a conductive track housed in a non-conducting layer and one twin-conductor constituted by two superposed conductive tracks housed in non-conducting layers.

4. System according to claim 1, wherein said electric contact pickup links are constituted by three single-conductor cables, each comprising one conductive track housed in a non-conducting layer.

5. System according to claim 1, wherein said half-shells are made of a rigid electrically non-conducting material.

6. System according to claim 1, comprising a holding device constituted by U-shaped spring plates having branches each housed in a said half-shell, said shape memory alloy collar opposing a force of said spring.

7. System according to claim 1, comprising a polarization device.

8. System according to claim 1, for connecting two shielded flat cables without any impedance rupture, comprising a conductive track for linking a first single-conductor cable allowing for contact pickup between first low voltage tracks of said two flat cables, a conductive track for linking a second single-conductor cable allowing for contact pickup between high voltage tracks of said two cables, and a conductive track for linking a third single-conductor allowing for contact pickup between two other low voltage tracks of said two cables.

9. System according to claim 1, for connecting a shielded flat cable and a coaxial cable, comprising a conductive track for linking of a single-conductor cable allowing for contact pickup between one low voltage track of said flat cable and an outer conductor of said coaxial cable, the conductive tracks for linking of a twin-conductor cable allowing for contact pickup between firstly a high voltage track of said flat cable and a central conductor of said coaxial cable, and secondly between a second low voltage track of said flat cable and an outer conductor of said coaxial cable.

10. System according to claim 1, comprising means for keeping said two half-shells in either spaced apart or in a closed position supplying pressure transmitted by said elastic pieces.

11. System according to any one of claims 1 to 10, wherein said elastic pieces are elastomer pads.

12. System according to claim 1, comprising a holding device constituted by springs housed in said half-shells at a junction point of said half-shells, said shape memory alloy collar opposing a force of said springs.

13. System according to claim 12, wherein said collar is provided with a spring plate.

* * * * *